US006062159A

United States Patent [19]

Cao

[11] Patent Number: 6,062,159

[45] Date of Patent: May 16, 2000

[54] AQUATIC VEHICLE

[76] Inventor: Thanh D. Cao, 529 E. Washington Blvd., #6, Pasadena, Calif. 91104

[21] Appl. No.: 09/134,317

[22] Filed: Aug. 14, 1998

Related U.S. Application Data

[63] Continuation-in-part of application No. 08/680,263, Jul. 11, 1996, abandoned.

[51] Int. Cl.[7] ..... B63B 1/00

[52] U.S. Cl. ..... 114/271; 114/123

[58] Field of Search ..... 114/123, 126, 114/59, 271, 331

[56] References Cited

U.S. PATENT DOCUMENTS

| | | | |
|---|---|---|---|
| 1,579,109 | 3/1926 | Haseley | 114/331 |
| 3,063,397 | 11/1962 | Boericke, Jr. | 114/126 |
| 5,467,728 | 11/1995 | Lucy et al. | 114/126 |
| 5,642,682 | 7/1997 | Pierce | 114/123 |

FOREIGN PATENT DOCUMENTS

| | | | |
|---|---|---|---|
| 590270 | 12/1933 | Germany | 114/59 |

*Primary Examiner*—Jesus D. Sotelo

*Attorney, Agent, or Firm*—Christie, Parker & Hale, LLP

[57] ABSTRACT

The aquatic vehicle includes centers of mass (COM), of propulsion (COP) and of resistance (COR); a propulsion force (P) provided by propulsion sources (43, 44 or 143, 144); a neutralization of the propulsion and resistance torques; double blade control surfaces (20, 22, 24, 26 or 120, 122, 124, 126), each having two blades mounted on the opposite sides of a rotational axis; the surfaces being arranged such that the control effects are transmitted through COM; lateral boards (28, 30, 32, 34 or 128, 130, 132, 134) to provide the vehicle a lift in motion and structures of displacement volume (70, 72) to support the vehicle at rest. In one embodiment, the vehicle includes top and bottom components (12, 14) of equal normal cross-sectional areas (w1, w2). In another embodiment, the vehicle includes top and bottom components (112, 114) and top and bottom extensors (116, 118).

18 Claims, 12 Drawing Sheets

BEGINNING
OF ACCELERATION
Y m1
L1
P = A
R = 0
COM
X
m1L1 = -m2L2
m1 < m2
l1 > l2
L2
m2

LOCATION
OF COR
Y

COR1
R1
D1
T1
D1XR1+D2XR2 = 0
TXR = T1XR1+T2XR2
X
T
COR
R = R1+R2
D2
T2
COR2
R2

LOCATION OF COR

Y
16
72
32
TOP
COMPONENT
12
26
34
BOTTOM
COMPONENT
14
16
TOP
COMPONENT
12
X
22
BOTTOM
COMPONENT
14

Y
70
W1
72
28
32
VERTICAL
17 POSITION
NEUTRAL
POSITION 17
Z
24
30
43
W2
44
34
26

AQUATIC VEHICLE

CROSS-REFERENCE TO RELATED APPLICATION

This application is a continuation-in-part of U.S. application Ser. No. 08/680,263 filed Jul. 11, 1996 now abandoned.

BACKGROUND OF THE INVENTION

This invention relates to the field of aquatic vehicles and more particularly to a novel design for submarines and surface vessels.

Fast moving surface vessels, such as jet-skis, power boats, hovercrafts and the like, suffer the de-stabilizing effect of surface roughness due to surface waves. The Navy hydrofoils, running on water jet engines mounted on underwater foils, are unstable vehicles, because their distribution of mass is off-balanced above the waterline; they are therefore difficult to maneuver at high speeds.

Conventional light weight submarines do not have high maneuverability; for instance, they cannot slide sideways, and reverse their forward/backward motion along the velocity line.

Besides being propelled and steered from the rear end, conventional light weight submarines have a relatively low Reynold number, and therefore high drag coefficient in comparing to that of the heavier submarines. Since the rear end maneuvering and high drag impair their stability at high speeds, conventional light weight submarines are limited to low speed operations.

BRIEF DESCRIPTION OF THE DRAWINGS

in FIG. 12A, the extensors are retracted (not seen) inside the components, and in FIG. 12B, the extensors, as seen, are extended outside the components.

in FIG. 12C, the extensors are retracted (not seen) inside the components, and in FIG. 12D, the extensors are extended, as seen, outside the components.

SUMMARY OF THE INVENTION

Figure 1:
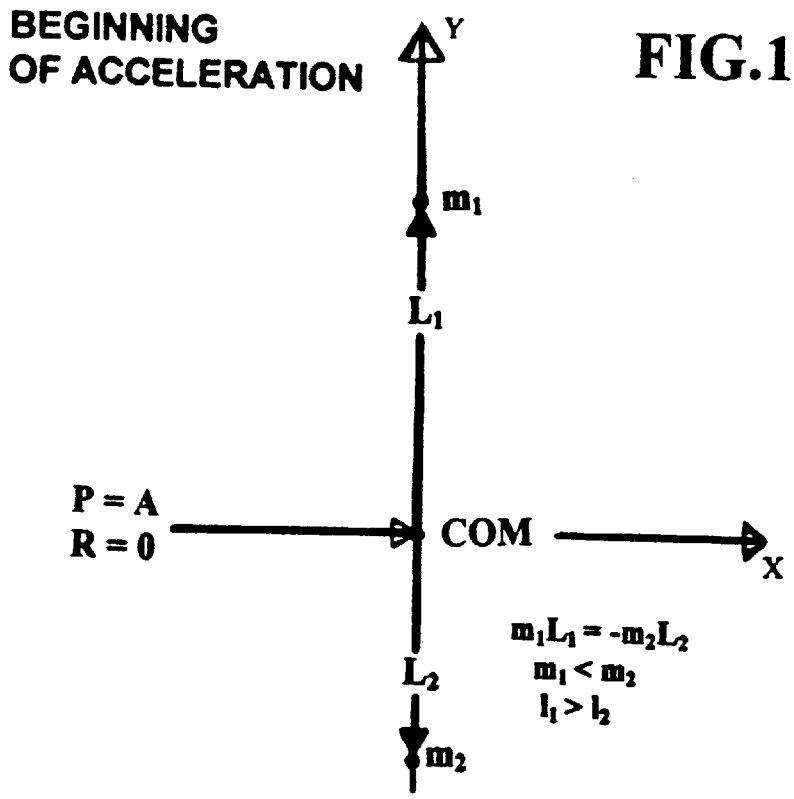
FIG. 1 through FIG. 3 are vector diagrams demonstrating an analysis of the first problem involving stability control in different stages of motion.

According to the invention, apparatus and methods are provided for an aquatic vehicle.

An aquatic vehicle includes propulsion sources, a top component, a bottom component, a system of structural adjustment, a control system, systems of lift arid of surface support.

The control system comprises control surfaces, each of which is designed to have two blades mounted oppositely on a rotational axis. Each surface is structured to be thicker and wider toward the aft edge. The surfaces are arranged so that they transmit their maneuvering effect through center of mass COM of the vehicle.

Besides COM, other points of consideration relating to the theory of the invention are COP, COR and COR';

center of propulsion COP is the point at which applied propulsion force P which is equivalent to the forces generated from the propulsion sources, center of resistance COR, applied the equivalent to the forces of resistance on the vehicle, and COR', the image of COR reflected through COM.

The systems of lift and surface support are adjustable to provide balance and restore dynamic shape for high speed performance.

In the first embodiment is surface vehicle 100. The top component is larger to provide passengers' space. The bottom component includes engines and heavy machineries confined in a volume smaller to minimize water resistance. The alignment of propulsion force P is adjusted by extending or retracting the extensor(s) of the system of structural adjustment to maintain the vehicle stability in different stages of motion. Analogous to a dolphin swimming with its trunk standing up, the top extensor is deployed out of the top component to elevate passengers above surface waves. The functions of underwater lateral boards (hydrofoils), of the system of lift, and double blade control surfaces are equivalent to that of the wheels and tires negotiating with the ground surface to move an automobile trunk through the air.

In another embodiment is undersurface vehicle 10. For high speed performance, the top and bottom components have similar shapes, besides equal normal cross-sectional areas.

COM of undersurface vehicle 10 is midway between the top and bottom components. COP coincides with COR at COM. Analogous to an airplane riding on wings (airfoils) through the air, undersurface vehicle 10 rides on lateral boards through water. Like the airplane, the aquatic vehicle, in motion, does not need Archimedes' force, consequently, it is faster, more maneuverable and more versatile than conventional submarines, because it is not burdened with the redundancy of displacement volume to float, and the water mass exchanged to dive.

Many of the attendant features of this invention will be more readily appreciated as the same becomes better understood by reference to the following detailed descriptions considered in connection with the accompanying drawings in which like reference symbols designate like parts throughout the figures.

DETAILED DESCRIPTION

The Aquatic vehicles represent two solutions, namely surface vehicle 100 and undersurface vehicle 10, to the following three interrelated problems with high speed motion through fluids, e.g. water and/or air.

The first problem is to determine the way to apply a given force of propulsion, P, on a vehicle to accelerate and decelerate it without causing any undesirable rolling effect. The solution to this problem defines the application of P and subsequently, the innovated structure of the aquatic vehicle to facilitate the application so defined.

Consequently, the second problem is to determine a design for the control surfaces so that they can retain their normal operability through stiff fluid resistance at high speed, and also under intense pressure at great depth, and the third problem is to determine an arrangement for the control surfaces on the innovated structure to optimize maneuvering control.

Furthermore, the systems of lift and of surface support provide an aquatic vehicle the advantages, over conventional watercraft, which are comparable to that of a fixed-wing aircraft over an airship or any of the like.

Figure 2:
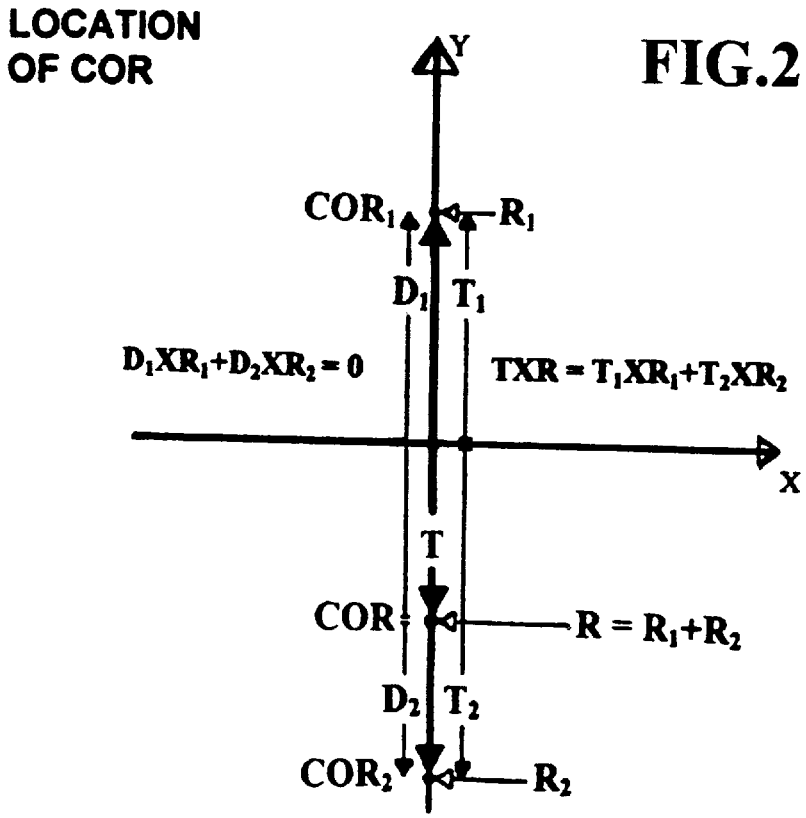
Figure 3:
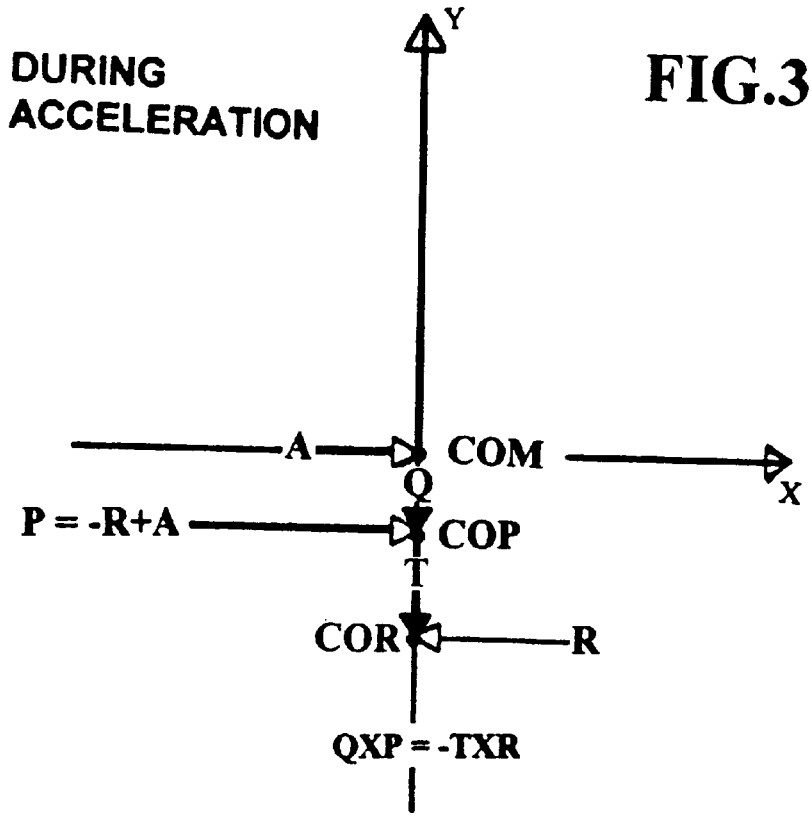

Structural Adjustment and Structural Configuration to Solve The First Problem FIG. 1 through FIG. 3 are vector diagrams demonstrating an analysis of the first problem.

To travel at higher speeds requires an exceptional stability. For that stability, conventional vehicles, such as speed boats and drag cars, have their structure extended lengthwise, and the catamarans and race cars, widthwise.

Appropriately, however, a fluid surface differs from a solid surface, and approaches to the problem of stability control on different surfaces must be different accordingly. Therefore, an aquatic vehicle, unlike conventional vehicles, acquires its stability, not by extending lengthwise or widthwise in the horizontal plane, but by redistributing its mass in the vertical dimension. Such a redistribution of mass provides the aquatic vehicle its exceptional stability without inducing any impairment of maneuverability due to the redundancy of a lengthwise and/or a widthwise extension.

The first problem addresses the de-stabilizing effect of propulsion and fluid resistance on a moving vehicle, and the solution, a proper way to apply propulsion force P, is a result from the vertical redistribution of mass.

Let COM be the center of mass of a vehicle. With respect to COM, the mass of the vehicle is representable by two point masses, m1 and m2, and the vehicle structure, by a system of two components, the top and the bottom, of which m1 and m2 are, respectively, their center of mass.

FIG. 1 shows m1 and m2 positioned on the y-axis of a structural reference frame which is a Cartesian frame of reference. For convenience, COM is positioned at the origin and therefore, the reference frame is also referred to as frame COM. Accordingly, $$m1L1+m2L2=0$$

where L1 is the position vector of m1 with reference to COM, and L2 of m2.

COM, as the Center of Mass, is considered here for the convenience of having the ratio L1/L2=m2/m1 to facilitate the proportional configuration of structural parts. In practice, COM is localized at the center of gravity about which the torques due to gravitational forces on all parts of the vehicle neutralize one another.

The symbols in this analysis are non-capital letters for scalar quantities, capital letters for vectors and cross products, such as QXP.

The vehicle is now analyzable in terms of a two component system. To accelerate the system in the x-direction while preventing it from rolling about the z-axis, the propulsion force, $$P=A$$

where A is the accelerating force, must be aligned through COM, as shown also in FIG. 1. However, the propulsion through COM can avoid causing undesirable rolling only at the initial time, and/or in empty space of zero resistance. In a massive fluid, e.g. water or air, the forces of resistance on the two components build up with increasing speed in the direction opposite to their velocity.

FIG. 2 shows the resistance forces, R1 on the top component and R2 on the bottom component. The equivalent is R=R1+R2 at COR, where COR is the center of resistance localized between COR1 and COR2 according to:

$$D1XR1=-D2XR2$$

where D1 is the position vector of COR1 and D2, of COR2, with reference to COR; COR1 and COR2 are, respectively, the centers of resistance of the top and bottom components.

COR, as Center of Fluid Resistance, is the point about which the torques due to resistance forces on all parts of the vehicle neutralize one another; in this case, the resistance forces are summarized in R1 on the top component and R2 on the bottom component. Like COM, found as the center of gravity at the intersection of two lines of gravitational force, center of resistance COR is found at the intersection of two lines of resistance force; when the object is towed through fluids in uniform motion, one of the force lines is the extension along a tow-line connected at a position on the towed object, and the other, a tow-line connected at a different position. In this way COR1 of the top component, COR2 of the bottom component and COR of the vehicle are determined experimentally.

While the torques due to R1 and R2 neutralize each other about COR, they do not neutralize each other about COM;

the sum of the resistance torques about COM defines the application positions of the resistance forces in frame COM according to:

$$TXR=T1XR1+T2XR2$$

where T is the position vector of COR, T1, of COR1 and T2, of COR2, with reference to COM.

Because of the growing resistance, R will no longer be zero once the vehicle picks up speed, and TXR, as well as the torque due to propulsion force P, causes the vehicle to roll about the z-axis as the vehicle proceeds in the x-direction.

For the present invention, the way, in which P is applied to neutralize de-stabilizing effects, involves:

- a movement of center of propulsion COP which corresponds to operation of a structural adjustment system on surface vehicle 100, and
- a fixation of center of propulsion COP which corresponds to a structural configuration for undersurface vehicle 10.

The Structural Adjustment System to Neutralize De-Stabilizing Effects

COP, as Center of Propulsion, is the point about which the torques due to all propulsion forces on the vehicle neutralize one another. Applied at COP is propulsion force P equal to the sum of all propulsion forces. The propulsion forces on the vehicle are generated from outputs of propulsive power or propulsion sources, such as propellers or jet-nozzles coupled to the vehicle.

Let Q be the position vector of COP with reference to COM; the torque due to P about COM is QXP.

As resistance force R grows with speeds, P must account for the counter-resistance force, −R, besides accelerating force A, i.e. P=−R+A.

Among the many approaches to the problem of de-stabilizing effects due to propulsion torque QXP and resistance torque TXR, the simplest and most efficient is a mutual neutralization, of QXP and TXR, in the form of QXP+TXR=0. Then, COP must have position vector Q, such that $$QXP=-TXR$$

or in terms of components, $$q=-tr/p.$$

FIG. 3 shows neutralization QXP+TXR=0 by proper position Q of COP.

Figure 4:
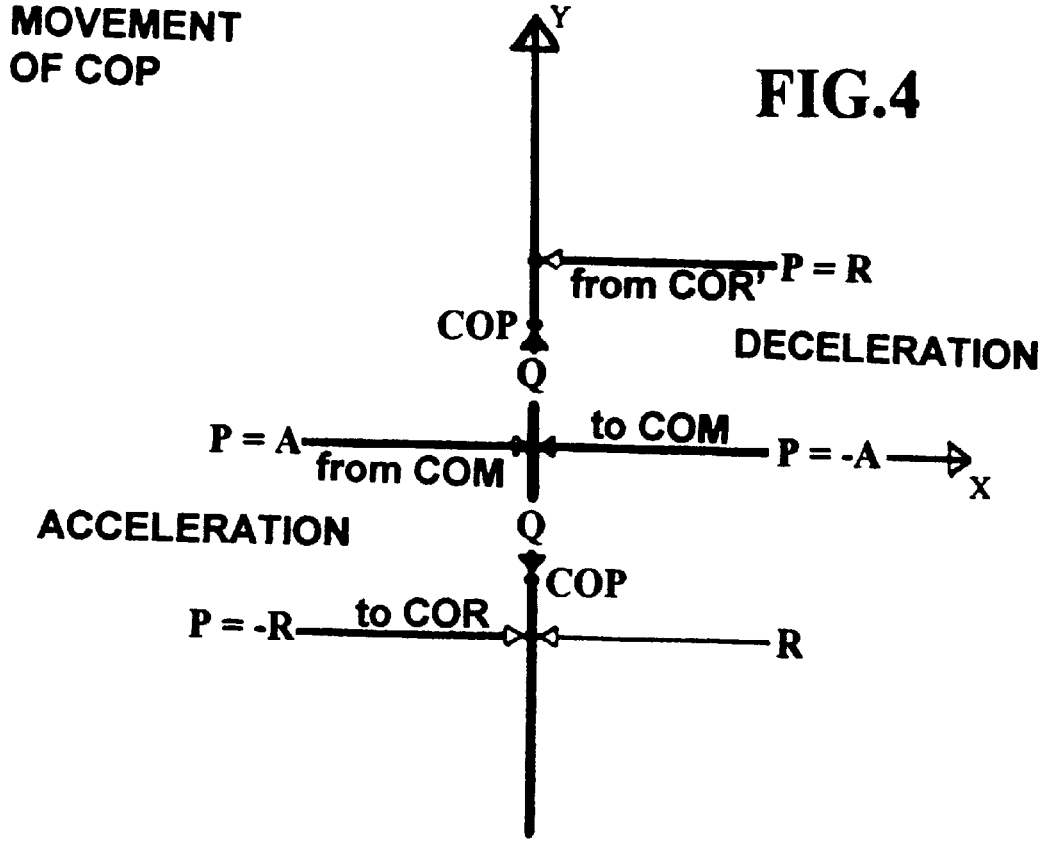
FIG. 4 is a vector diagram demonstrating a solution, represented by surface vehicle 100, to the first problem.

As shown in FIG. 4 while P and T are unchanging, R increases with speed during acceleration. To maintain neutralization QXP+TXR=O, Q must vary, and COP moves accordingly,

- from the level of COM at the beginning of acceleration, when P=A, R=O and QXA+TXO=0, or q=0,
- to the level of COR at the end of acceleration, when the vehicle reaches its maximum terminal cruising speed, while A=O, P=−R and QX(−R)+TXR=0, or q=t.

Conversely, FIG. 4 also shows the traveling process of COP during deceleration, from COR' to COM, where COR' is the image of COR reflected through COM;

- at COR', A=O and P=R, and
- at COM, P=−A and R=O.

In practice, the decelerating effect is generated by reducing the propulsive power while increasing surface exposure of the vehicle to fluid resistance by, for instance, lowering the top component onto water. With the power reduced, then turned off, the process of the resistance force decreasing with speed, and disappearing at full-stop, resembles the movement of COP, from COR' to COM, and the removal of P=−A for deceleration.

Figure 12A:
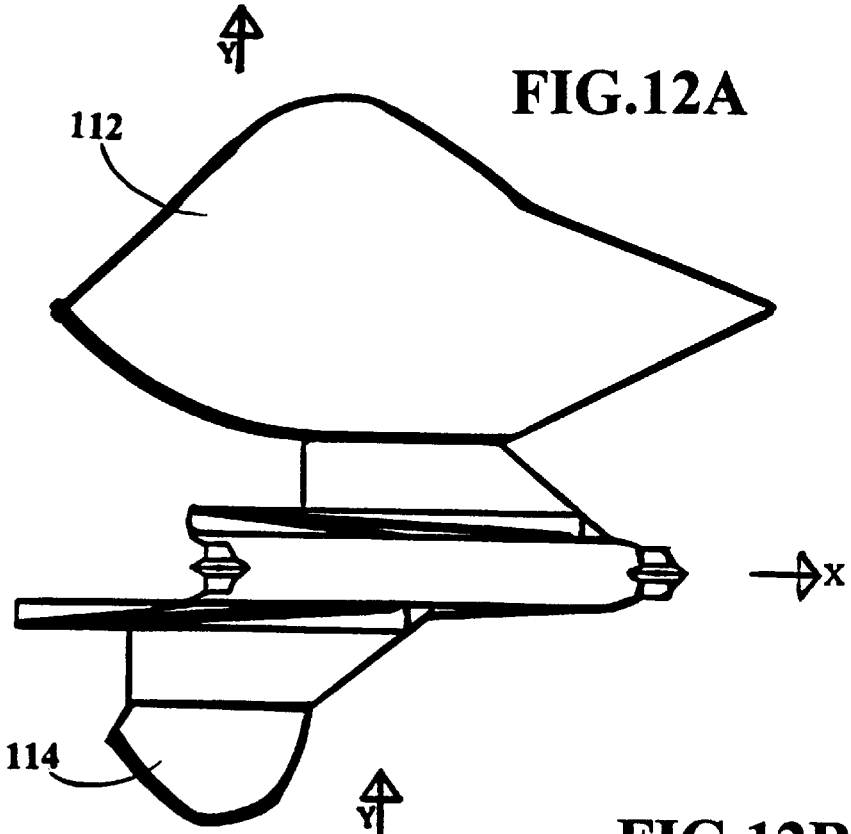
FIG. 12A, FIG. 12B are elevational side views demonstrating surface vehicle 100, as a solution to the first problem, with operational extensors, 116 and 118.
Figure 12B:
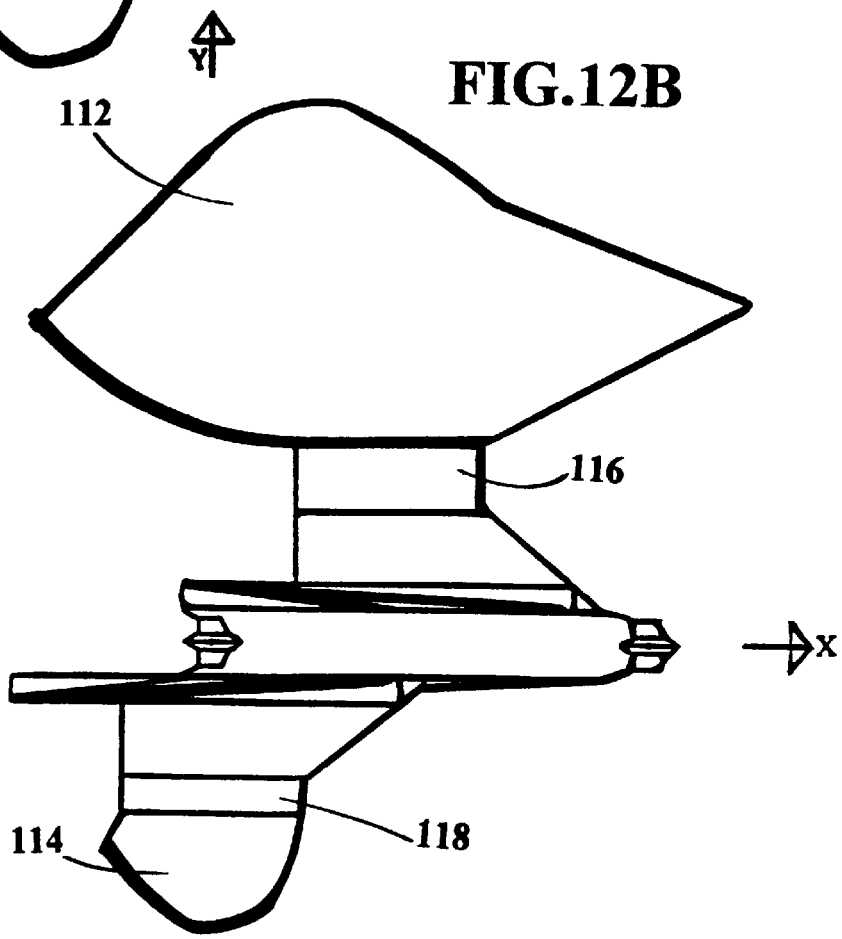
Figure 12C:
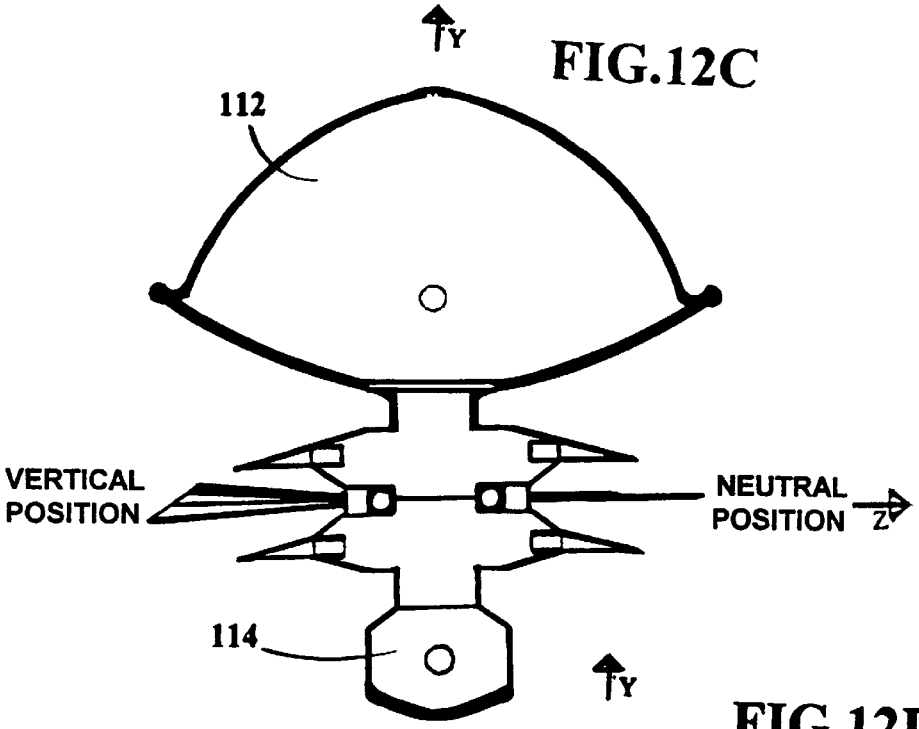
FIG. 12C, FIG. 12D are elevational rear views demonstrating another view of surface vehicle 100 with operational extensors, 116 and 118.

The above described movement of COP, from q=0 to q=t, to maintain q=−tr/p for neutralization QXP+TXR=0, corresponds to operation of the structural adjustment system on Vehicle 100. Shown in FIG. 12B are top extensor 116 and bottom extensor 118, of the structural adjustment system, extended outside the components. The extensors are not seen in FIG. 12A, as they are retracted inside the components.

- Surface Aquatic Vehicle 100 with a Structural Adjustment System of One Extensor
  - Operation of either top extensor 116 or bottom extensor 118 is sufficient to maintain the length of q, so that q=−tr/p for neutralization QXP+TXR=0; the extensor is extended or retracted to adjust the length of q depending on the variation of r and p.
- Surface Aquatic Vehicle 100 with a Structural Adjustment System of Top and Bottom Extensors
  - To maintain an elevation of the top component, variation of the top extensor can be compensated with a variation of bottom extensor 118. For instance, when top extensor 116 is sufficiently extended to provide passengers a desired elevation above surface waves, a variation of bottom extensor 118, for further adjustment, will help maintain the desired elevation which would, otherwise, be altered by an adjustment of the top extensor.

The Structural Configuration to Neutralize De-Stabilizing Effects

On conventional surface vessels, stability for high speed motion is ordinarily obtained from a horizontal redistribution of mass; for examples, as mentioned previously, a speedboat, like a drag-car, obtains its stability from a structural lengthening for a lengthwise redistribution of mass, and a catamaran, like a race car, obtains its stability from a structural widening for a widthwise redistribution of mass. Such a horizontal redistribution, lengthwise or widthwise, does not lead to a neutralization of the de-stabilizing propulsion and resistance torques, QXP and TXR, and the boat, therefore, pitches up during acceleration and down, during deceleration. During uniform motion, the up-pitching remains unchanged due to a neutralization in the form of EXC+QXP+TXR=0, where EXC is the uncontrolled gravitational torque resulting from the gravitational force on the boat. Generally, EXC would also include the stabilizing effect generated from an operational system which is usually unavailable on conventional watercraft.

Because the gravitational force is uncontrolled, the required control power for EXC is usually unnoticed. Often times, such boats, and jet-skis as well, roll over on water surface, because gravitational torque EXC cannot be operated to keep up with an increasing variation of QXP, and consequently of TXR, in maintaining neutralization EXC+QXP+TXR=0. With COP fixed and, therefore, Q unchanging on a conventional watercraft, the EXC of EXC=−QXP−TXR requires the most power to operate in uniform motion, when the magnitudes of P and R reach their maximim of R=−P at terminal speed. Evidently, said speedboat is more vulnerable to surface roughness during uniform motion than in other stages of motion at lower speeds. Therefore, to maintain a stabilization for higher speeds, the uncontrolled gravitational torque must be replaced with an operable EXC powered by a control system that is capable of measuring up to the increasing variation of QXP. Thus, the need for stability control becomes more noticeable when propulsion force P causes the de-stabilizing effect of QXP, and consequently of TXR, to exceed the limited stabilization provided by the uncontrolled CXE of gravitational torque.

Figure 5:
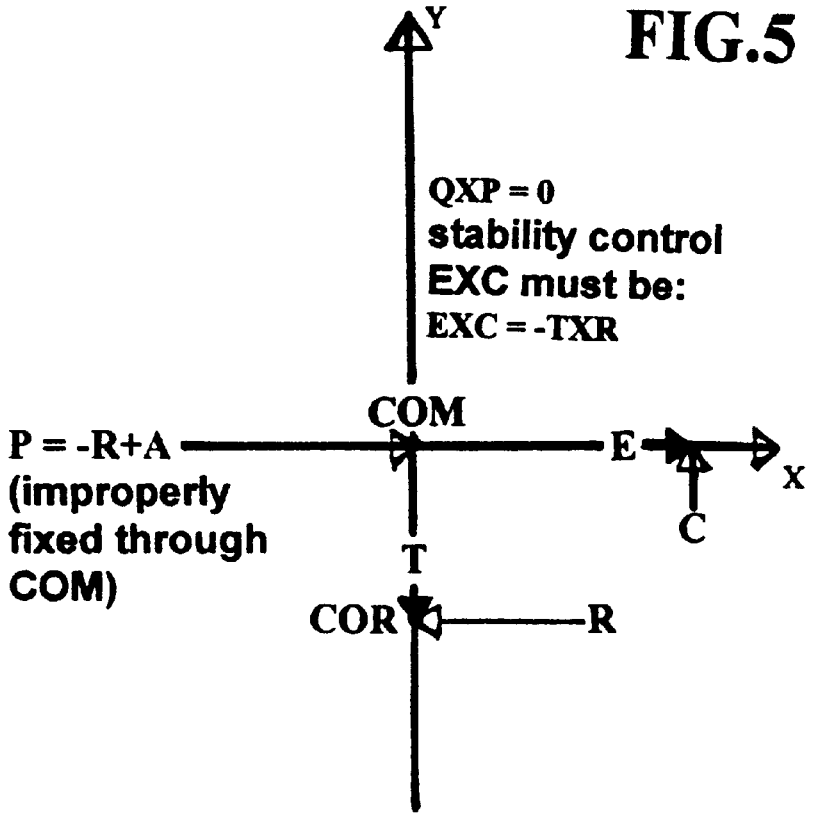
FIG. 5 is a vector diagram demonstrating the first step toward the solution represented by undersurface vehicle 10—the elimination of de-stabilizing propulsion torque QXP.

Conventionally, the common step to take is to simplify neutralization CXE+QXP+TXR=0 by eliminating QXP. FIG. 5 shows the usual way to eliminate QXP by aligning P through COM. The alignment makes Q=O and, therefore, QXP is eliminated; then, CXE+QXP+TXR=0 becomes CXE+TXR=0 or CXE=−TXR.

Figure 6:
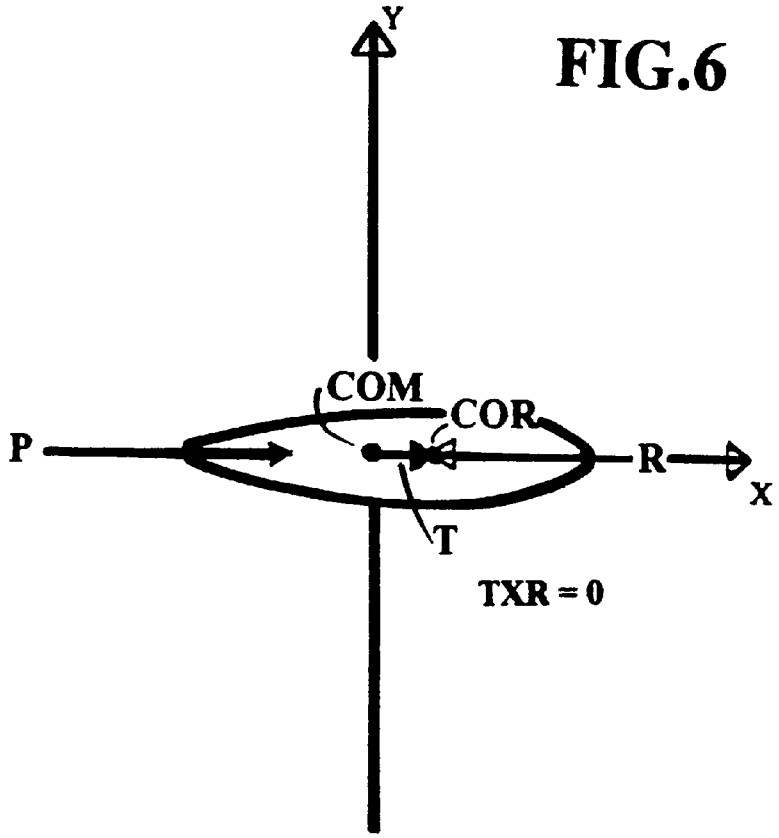
FIG. 6 and FIG. 7 are vector diagrams demonstrating one of the two remaining problems after the first step in FIG. 5—the problem with lengthwise distribution of mass on conventional submarines.
Figure 7:
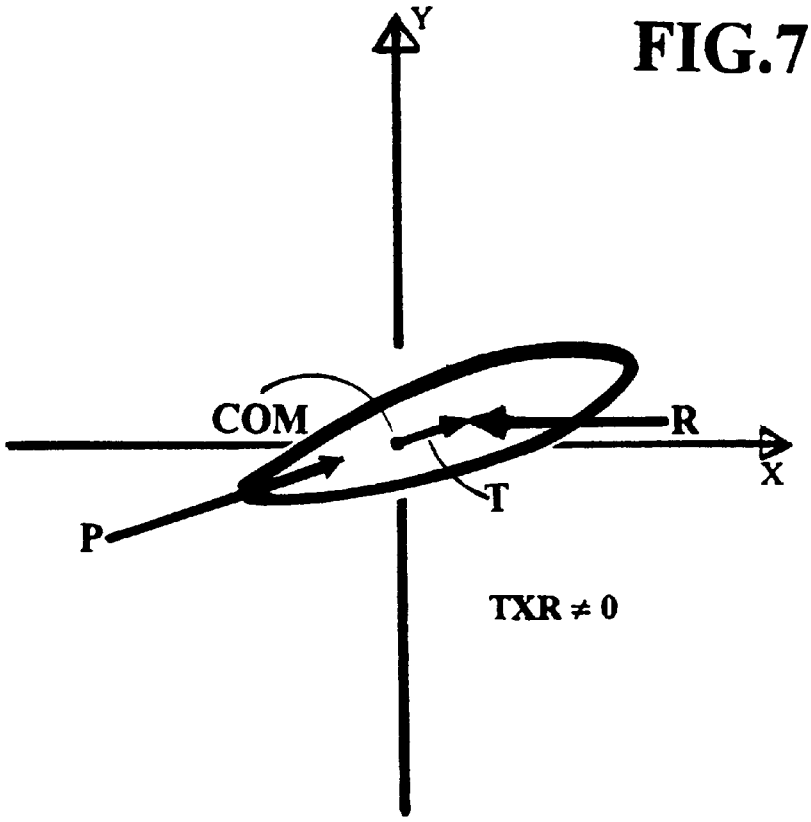
Figure 8:
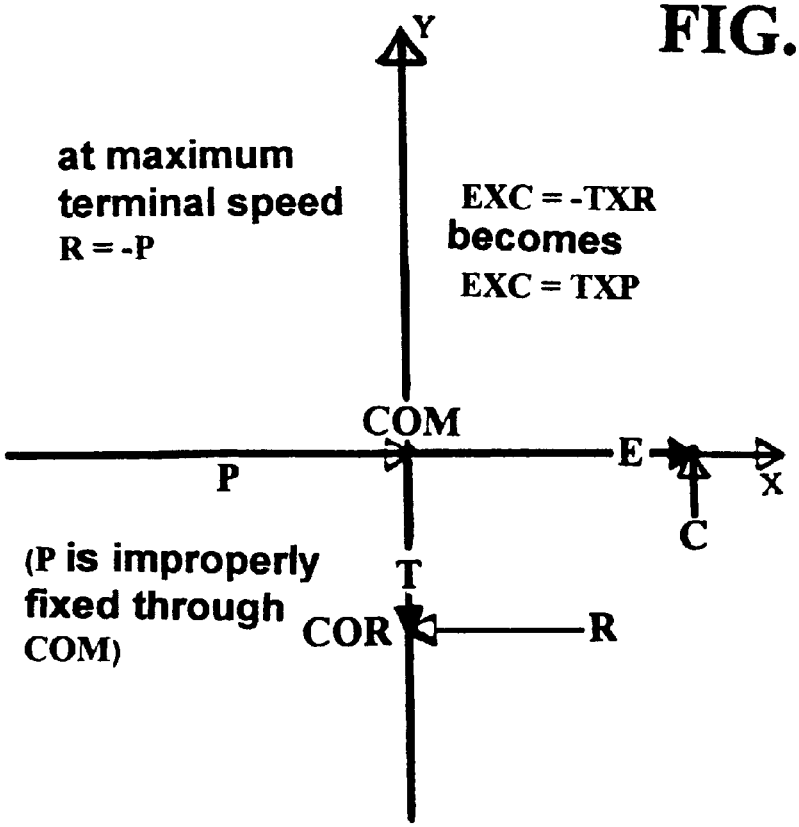
FIG. 8 is a vector diagram demonstrating another problem remaining after the first step in FIG. 5—the problem involving maximum de-stabilizing effect of resistance torque TXR.

After the elimination of QXP, problems with remaining TXR, in CXE+TXR=0, are shown in FIG. 6 through FIG. 8.

FIG. 6 and FIG. 7 present common problems involving conventional submarines, and FIG. 8, a critical effect of TXR at terminal speed, when R=−P. An elaboration on the common problems, in FIG. 6 and FIG. 7, is as follows.

Unlike automobiles and surface boats, submarines and aircraft travel through a medium which embeds their body totally. These vessels are conventionally so structured to have the total force or propulsion, P, aligned with their COM, so that Q and P are in line, to eliminate QXP.

Shown in FIG. 6 is a submarine symmetrical about its longitudinal axis. The symmetry allows the submarine to perform quite efficiently in its linear motion along the x-axis, because by the symmetry, R aligns with P through COM and COR. Since R and T are co-linear, TXR=O and EXC is not necessary. However, their maneuverability, particularly that of large size vessels, is eventually impaired by medium resistance. The impairment is commonly critical in sudden deceleration, e.g. when the propulsive power, or part of it, is accidentally cut off while the vessel is moving at high speeds; consequently, a stalling submarine or aircraft rolls out of control.

Shown in FIG. 7 is another typical disadvantage. When the submarine exposes its asymmetrical front and rear structures, due to either the uneven mass distribution or the difference in dimensions and shapes, to the relative water flow during a directional change, R and T are no longer in line, and therefore TXR is not zero. If the maneuvering mechanism of EXC malfunctions in this time at high speeds, the submarine may roll out of control.

Figure 9:
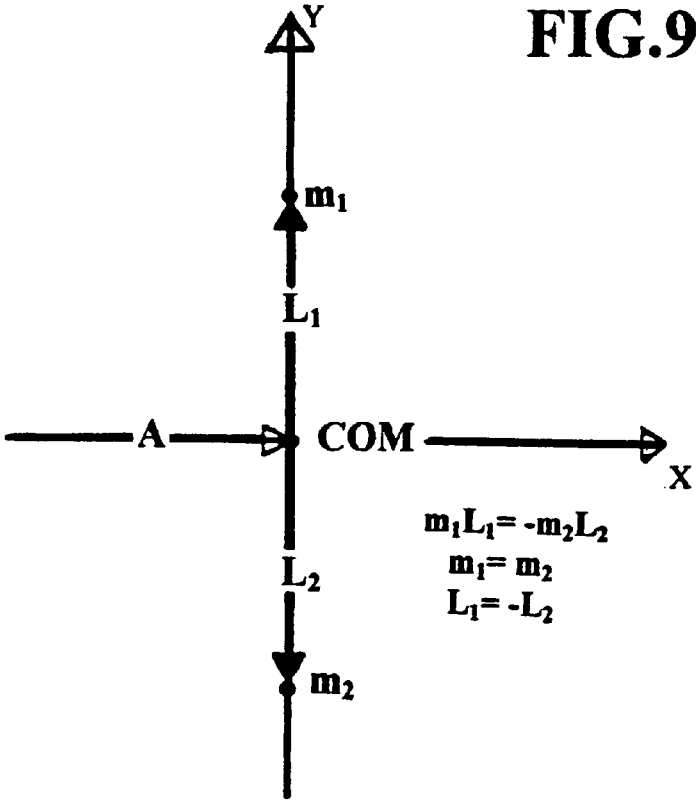
FIG. 9 is a vector diagram demonstrating a solution to the problem with lengthwise distribution of mass in FIG. 6 and FIG. 7—a vertical redistribution of mass equally in the top and bottom components.

The above described disadvantages, in FIG. 6 and FIG. 7, relate primarily to the lengthwise distribution of mass on conventional submarines. A vertical redistribution of mass, to resolve those common problems, is shown in FIG. 9. In this case, of undersurface vehicle 10, the two masses, m1 of the top and m2 of the bottom components, are equal, and COM is midway between m1 and m2.

Figure 10:
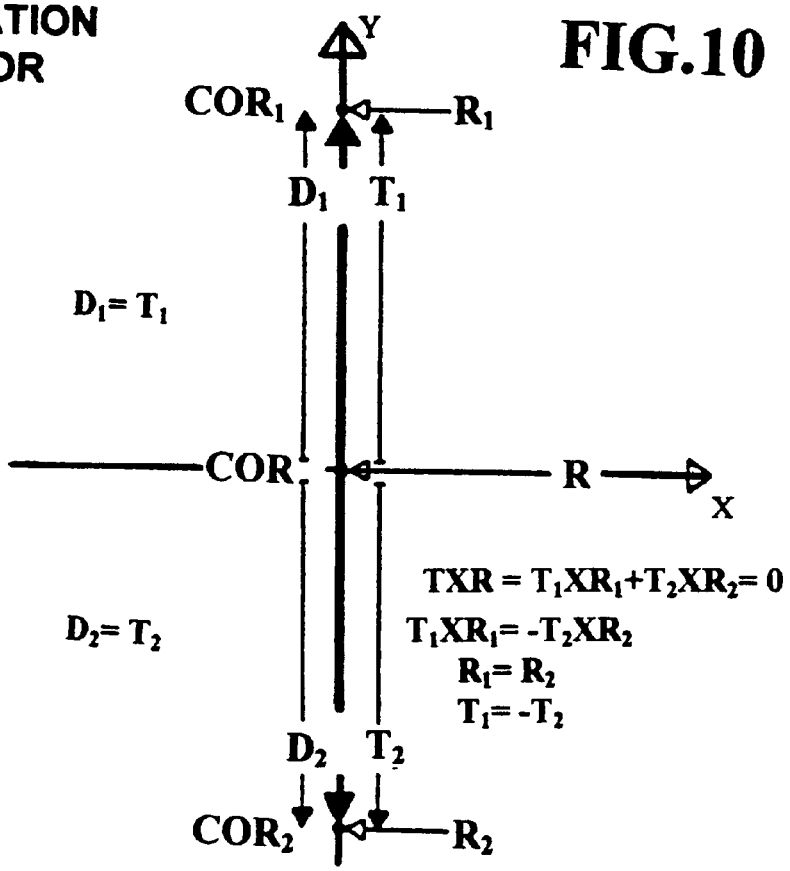
FIG. 10 is a vector diagram demonstrating a solution to the problem involving maximum de-stabilizing effect of TXR in FIG. 8—a neutralization of TXR by equalizing fluid resistance forces, R1 on the top component and R2 on the bottom component, to have COR coincide with COM.

Solution to the problem relating to TXR in FIG. 8 is shown in FIG. 10, where fluid resistance forces, R1 and R2, are equalized to bring COP to the midpoint at COM, and the effect of TXR becomes null, since T=O.

With COR at COM, its image, COR', by the reflection through COM, also coincides with COM. With the alignment of P through COM, as considered in FIG. 5 to eliminate QXP, the problem with rolling prevention is thus resolved in all phases of motion; COP no longer has to travel, neither from COM to COR during acceleration, nor from COR' to COM during deceleration, and CXE is no longer needed for neutralization CXE+QXP+TXR=0, since QXP was already eliminated and TXR was null.

To have R1=R2 for a structural configuration of undersurface vehicle 10, consider the following cases of fluid resistance and the corresponding conditions for R1=R2.

The Effect of Pressure in The Direction Opposite to The Direction of Motion

In the case of an aquatic vehicle moving in the x-direction, the pressure is on the cross-sectional areas normal to the x-direction; pressures in the direction parallel to the normal areas do not effect the vehicle motion in the x-direction. Therefore, to have equal resistances due to the effect of pressure on the two components, the normal cross-sectional areas, w1 of the top component and w2 of the bottom component, must be equal.

The Drag Effect Due to Surface Friction Which Depends on The Shape of The Moving Object Surface friction, in the case of an aquatic vehicle, is minimized by the dynamic shapes of the components, therefore, to have equal resistance due to the drag effect on the component, the shapes of the components must be similar.

Undersurface Vehicle 10 for Basic Performance

The drag effect is negligible in comparing to the effect of pressure, when high speed performance is not required. Therefore, for basic performance, vehicle 10 comprises component 12 and component 14 of equal normal cross-sectional areas, i.e. w1=w2; the condition of similar component shapes is not necessary.

Figure 11A:
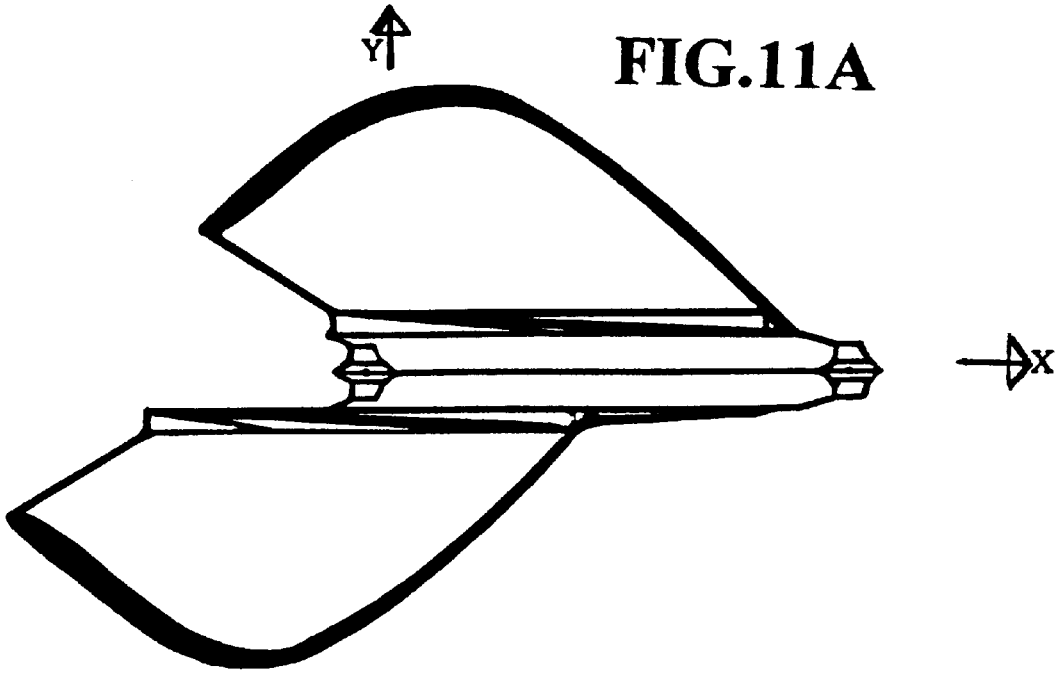
FIG. 11A is an elevational side view of undersurface vehicle 10 demonstrating one of the two requirements for the equalization of R1 and R2—the criteria of similar component shapes.
Figure 11B:
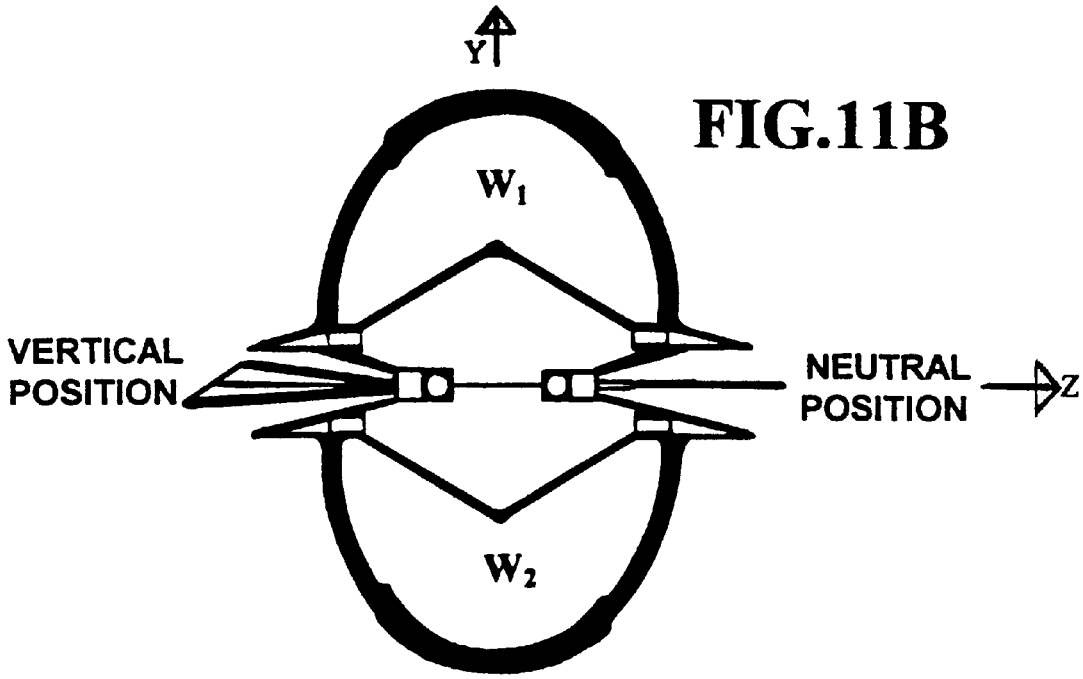
FIG. 11B is an elevational rear view of undersurface vehicle 10 demonstrating another requirement for the equalization of R1 and R2—the criteria of equal normal cross-sectional areas.
Figure 16:
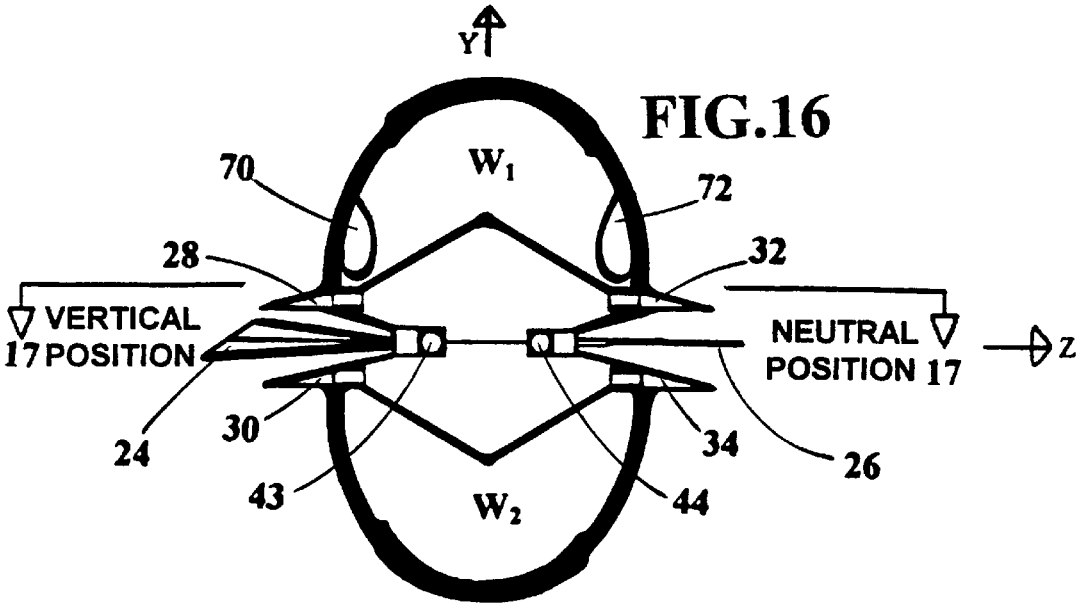
FIG. 16 is an elevational rear view of undersurface vehicle 10 in accordance with the present invention along line 16—16 of FIG. 15.
Figure 17:
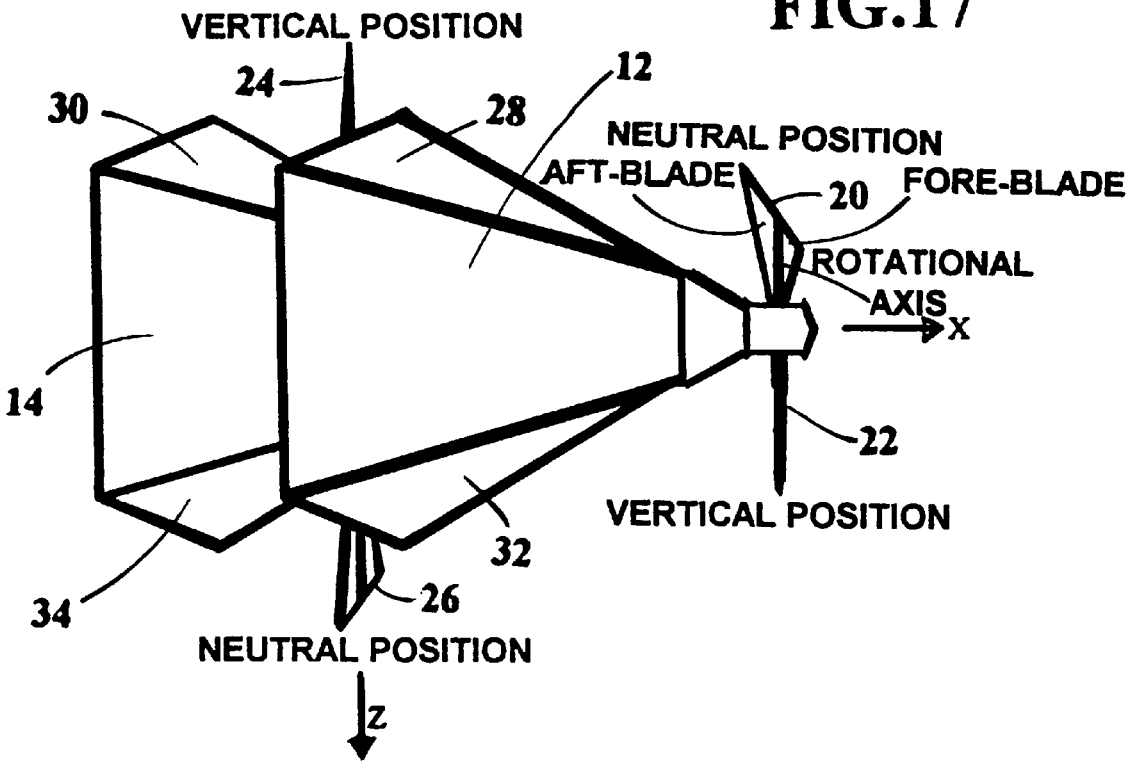
FIG. 17 is a sectional top view of undersurface vehicle in accordance with the present invention along line 17—17 of FIG. 16.

The equal normal cross-sectional areas of Vehicle 10 are shown in FIG. 11B and FIG. 16

Undersurface Vehicle 10 for High Speed Performance

At high speed, the drag effect of surface friction on the two components becomes significant.

Therefore, for high speed performance, vehicle 10 comprises component 12 and component 14, not only of equal normal cross-sectional areas, but also of similar shapes.

The similar shapes of top component 12 and bottom component 14 of vehicle 10 are shown in FIG. 11A, FIG. 11B, FIG. 15 and FIG. 16.

The Double Blade Control Surfaces and Their Arrangements to Solve The Second and Third Problems The second problem involves a double blade design of control surfaces, and the third problem, an arrangement of the control surfaces.

The Double Blade Control Surfaces to Solve The Second Problem

Figure 13:
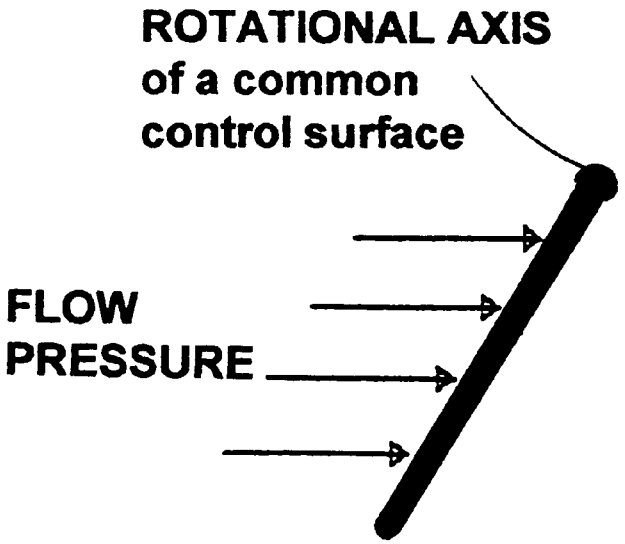
FIG. 13 illustrates the second problem.
Figure 14:
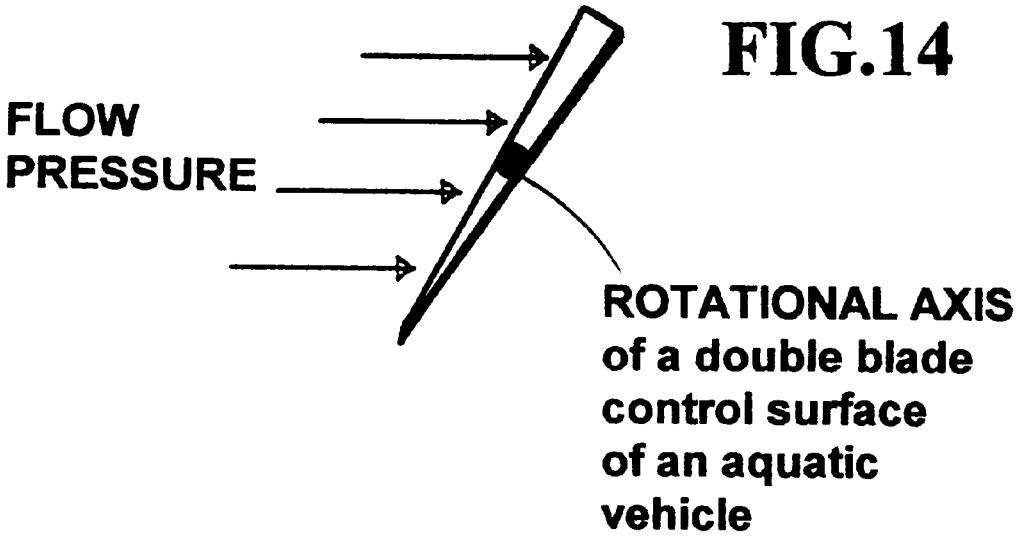
FIG. 14 illustrates a solution to the second problem—the double blade control surface.

FIG. 13 and FIG. 14 illustrate, respectively, the second problem and a solution to the second problem with a double blade control surface.

As shown in FIG. 13, a boat rudder or an airplane wing flap, for instance, commonly has only one blade hinged to one side of its axis. Because fluid pressure, on the only blade, impairs axial rotatability, operation of such a control surface becomes severely limited under high pressure.

FIG. 14 illustrates a solution to restore the axial rotatability—a control surface of two blades mounted on the opposite sides of a rotational axis. Because the torques due to fluid pressure on the opposite blades are equal in magnitude and opposite in direction, they neutralize each other and consequently, a double blade control surface can operate more freely and efficiently in high speed motion, and also at great depth.

Furthermore, a double blade control surface, as shown also in FIG. 14, is widened and thickened rearward, in the direction of fluid flow;

the increase of thickness induces a laminar flow to avoid turbulence effect, and the increase of width provides an "arrow effect" to retain the surface in its neutral position through fluid flow.

Without the impairment by fluid pressure, the double blade control surfaces can be linked, by means of cables and rods, to control instruments, such as paddles to operate by feet or handles to operate by hands. The control linkages are similar to that for the steering of a water jet nozzle on a jet-ski or the operation of wing-flaps and rudders on a light aircraft. Rotational controls of the heavier control surfaces on large size vessels can be further assisted with hydraulic power.

Arrangement of The Control Surfaces to Solve The Third Problem

Basically, a pair of operational double blade control surfaces, installed bilaterally, is sufficient to provide a controlled stability more reliable than the limited stabilization obtained from uncontrolled gravitational torque on conventional watercraft. However, to optimize maneuvering control, control effects should not offset the vehicle stability; the effects ought to be transmitted through COM. Therefore, as a solution to the third problem, two pairs of control surfaces are installed bilaterally, frontward and rearward from the z-axis. To transmit their effects through COM, the front and rear control surfaces are operated in coordination, so that the torques which they generate about the z-axis are equal in magnitude;

when the two torques are in the same direction, their resulting effect is transmitted through COM translationally along the y-axis, when the two torques are in opposite directions, their resulting effect is transmitted through COM rotationally about the z-axis.

Controls with The Double Blade Surfaces

Effects by the control surfaces on an aquatic vehicle are similar to that by the wing-flaps on an airplane. The effects result from pressure of fluid flow incident on the surfaces which are rotated at an angle from their neutral position.

Translational Transmission of Control Effects through COM

When rotation of the surfaces, as viewed along the positive z-direction, is clockwise in both, front and rear, the control effect is transmitted translationally along the y-axis (through COM) in the positive direction, and the vehicle ascends. When the rotation is in the opposite direction, the vehicle descends.

Translational effect, along the y-axis, allows a moving aquatic vehicle to ascend or descend without changing its body orientation.

Rotational Transmission of Control Effects through COM

When rotation of the surfaces, as viewed along the positive z-direction, is clockwise in the front and counterclockwise in the rear, the control effect is transmitted rotationally about the z-axis (through COM) in the clockwise direction; consequently, the vehicle turns upward as it moves forward. When the rotations of the surfaces are in the opposite directions, the vehicle turns downward as it moves forward.

Rotational effect, about the z-axis, allows a moving aquatic vehicle to change its body orientation, upward or downward.

The Control Surfaces of Undersurface Vehicle 10

The double blade control surfaces of undersurface vehicle 10 are depicted in FIG. 15 through FIG. 18, including bilateral installations of front control surfaces, 20 and 22, and rear control surfaces, 24 and 26.

The Control Surfaces of Surface Vehicle 100

Figure 19:
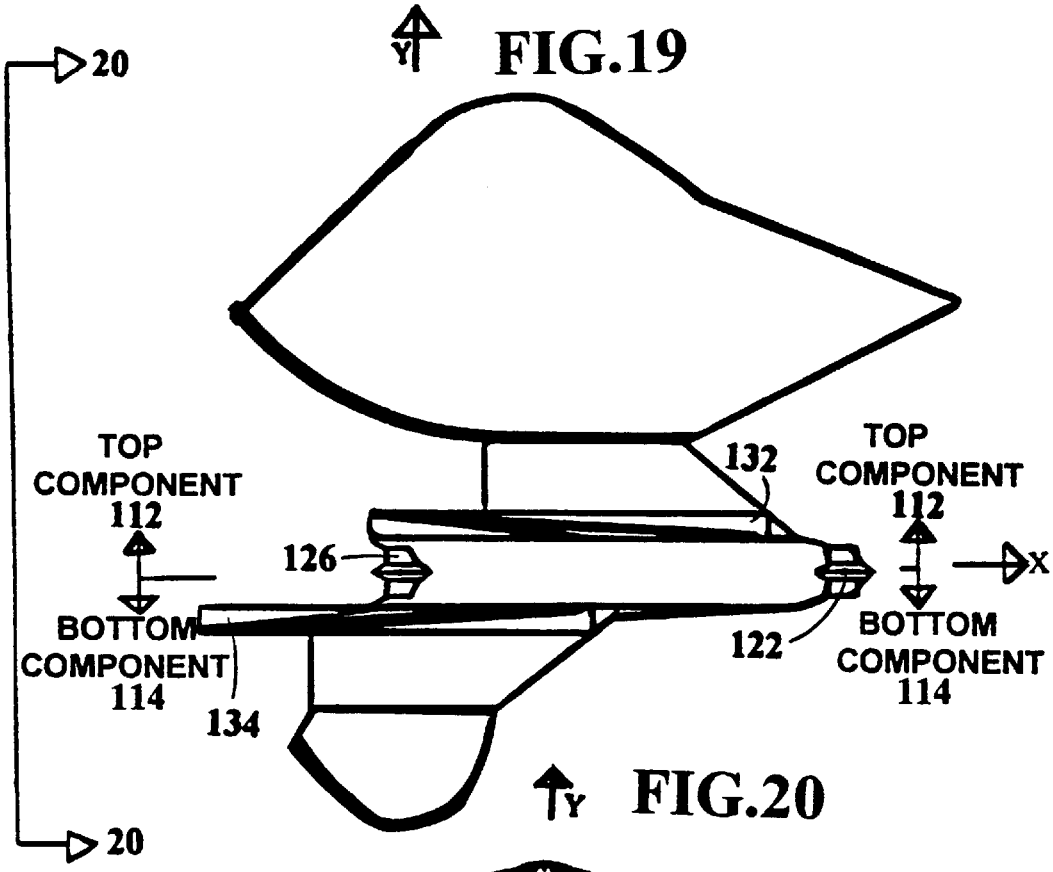
FIG. 19 is an elevational side view of surface vehicle 100 in accordance with the present invention.
Figure 20:
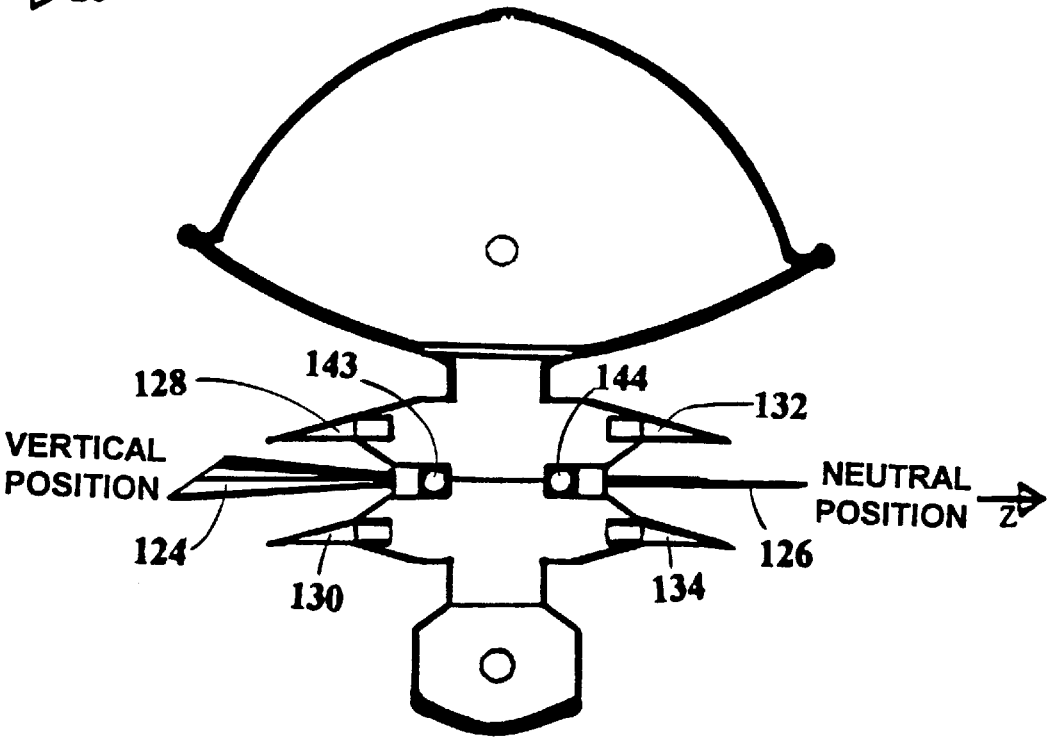
FIG. 20 is an elevational rear view of surface vehicle 100 in accordance with the present invention along line 20—20 of FIG. 19.

The double blade control surfaces of surface vehicle 100 are depicted in FIG. 19 and FIG. 20, including bilateral installations of front control surfaces, 120 and 122, and rear control surfaces, 124 and 126.

The System of Lift

The system of lift provides a moving aquatic vehicle the lift, an opposition to gravitational force, which resembles air lift provided by the wings to maintain an airplane in the air.

For the present invention, a system of lift comprises lateral boards which generate lifting force L by their reaction to relative fluid flow. On an aquatic vehicle, lifting force L replaces the ordinary buoyant force on a conventional watercraft, and allows the aquatic vehicle to move in or on water as an airplane in the air.

Controls with The Lateral Boards

Basically, a pair of lateral boards, installed bilaterally in the vicinity of the z-axis, is sufficient to provide the necessary lift. For a heavy vehicle of sizable volume, two pairs of lateral boards are bilaterally installed, frontward and rearward from the z-axis, to distribute and adjust the lift.

To Distribute The Lift

Figure 18:
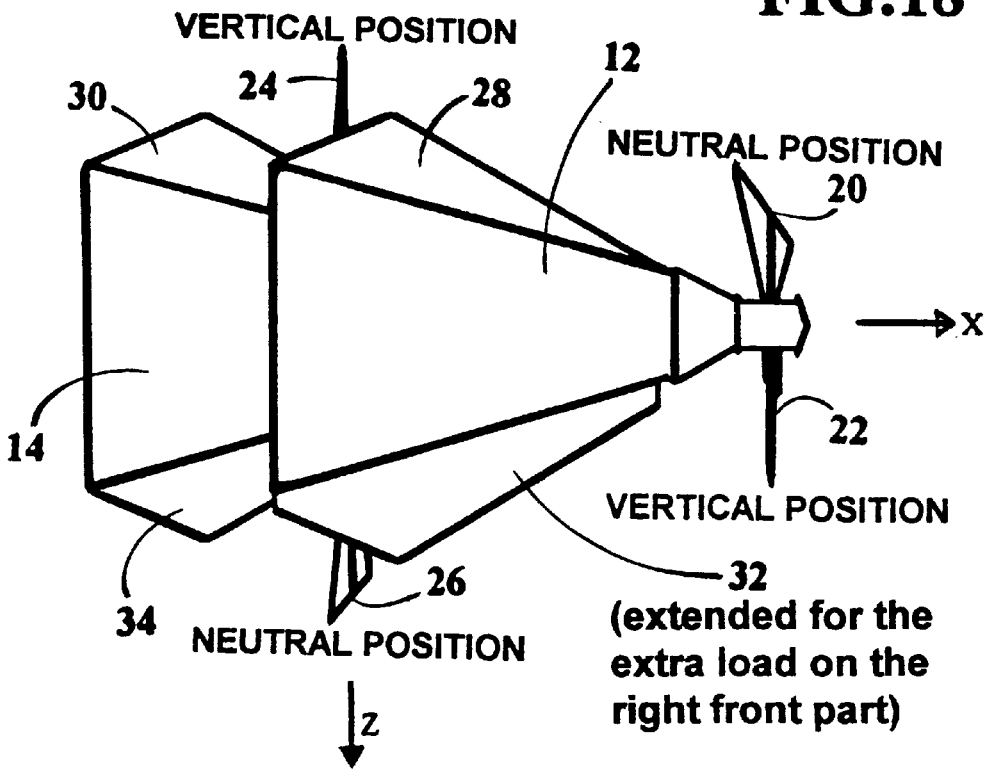
FIG. 18 is the same view of FIG. 17 to show a lateral extension of right front lateral board 32.

A lateral board is laterally adjustable to distribute the lift. As an example, FIG. 18 shows a lateral deployment of right front board 32 to provide additional lift for the extra load in the right front part of the vehicle. The lift is distributed, in accordance with different loads in different parts of the vehicle, to maintain the vehicle balance for more effective stabilization.

To Adjust The Lift

The retrieval and deployment of lateral boards, to increase and decrease the overall lift, control the elevation of a moving undersurface aquatic vehicle. This control effect is similar to the effect of pumping water in and out of the exchange chambers to increase and decrease gravitational force on a conventional submarine.

The Lateral Boards on Undersurface Vehicle 10

FIG. 15, FIG. 16, FIG. 17 and FIG. 18 show front lateral boards, 28 and 32, and rear lateral boards, 30 and 34, on undersurface vehicle 10.

The Lateral Boards on Surface Vehicle 100

FIG. 19 and FIG. 20 show front lateral boards, 128 and 132, and rear lateral boards, 130 and 134, on surface vehicle 100.

The System of Surface Support

The system of surface support provides an aquatic vehicle the support, a reaction to gravitational force, which resembles the support provided by the landing gears to maintain an airplane on the ground surface.

For the present invention, a system of surface support comprises apparatus of retrievable supporting structures; when the structures are deployed, they provide supporting force S to maintain a vehicle on a surface. On an aquatic vehicle, supporting force S is the buoyant force on the deployed structure of displacement volume. Force S maintains the vehicle on water surface when it is at rest or in slow motion. When lifting force L, by lateral boards, becomes effective at sufficient speeds, the structures are retrieved to restore the vehicle dynamic shape; in this way, the structures of displacement volume are similar to the retrievable landing gear structure of an airplane.

A means for deploying the displacement volume is by air pressure, such as for the air-bags. For an advanced system, the support apparatus includes displacement volume of solid hollow structures; the structures are deployed and retrieved by means of hydraulic power.

Figure 15:
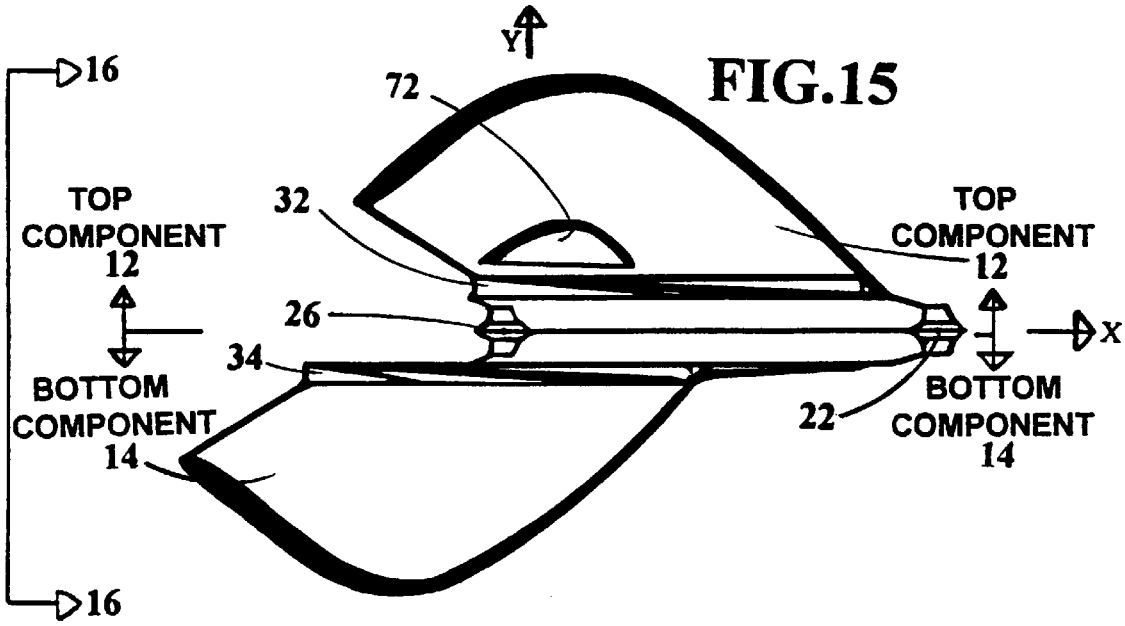
FIG. 15 is an elevational side view of undersurface vehicle 10 in accordance with the present invention.

Since surface vehicle 100 can be built with permanent floatation, a system of surface support is optional. On undersurface vehicle 10, a pair of left and right structures of displacement volume, 70 and 72, as shown in FIG. 15 and FIG. 16, are installed bilaterally on top component 12, in a vicinity above the zx-plane.

Novelties of the Aquatic Vehicles

In the air, two kinds of aircraft are differentiated to clarify the novelties of the present invention; they are:

the airplanes that move on wings (airfoils) reacting to relative air flow, and airships, or balloons and the like, that move on the displacement volume of floatation.

In water, however, the only kind of watercraft is of submarines that move, like the airships or balloons, on the displacement volume of floatation. This invention introduces another kind of watercraft, namely undersurface aquatic vehicle 10, that moves on lateral boards (hydrofoils) reacting to relative water flow, similar to an airplane on wings.

Theoretically, undersurface vehicle 10 represents one of the results deduced from a general analysis, as shown in FIG. 1 through FIG. 4, for surface aquatic vehicle 100. In accordance with the analysis, surface vehicle 100 represents a proper approach to the problem of stability control for motion on a fluid surface. The proper approach is to provide surface vehicle 100, and also undersurface vehicle 10 as a related result, the following advantages over conventional watercraft which are commonly designed without due consideration for the difference between solid and fluid surfaces.

Advantages with Steering Controls

When a vehicle is steered to turn, the steering acts on the vehicle, not on its passengers; as the vehicle turns, passengers do not, but their seat does, because the seats are fixed to the vehicle. Therefore, passengers lose balance during the turn, because their seat moves off underneath; for instance, by steering the front wheels, passengers in an automobile are thrown off balance in the direction opposite to the turn, as the front of their vehicle is pulled in the turning direction, and by steering the jet nozzle in the rear end, passengers on a jet-ski are thrown off balance in the direction of the turn, as the rear of their vehicle is pushed in the direction opposite to the turning direction.

By the vertical redistribution of mass, the propulsion sources and control surfaces, of an aquatic vehicle, generate a spinning effect about the y-axis for steering controls. A change of direction by spinning about the y-axis, instead of pulling on the front or pushing in the rear, helps passengers maintain their balance and remain in their seat with more ease.

Steering Controls with Propulsive Power

To provide steering controls, propulsion sources on an aquatic vehicle are installed symmetrically through the xy-plane. In linear motion, propulsive power is evenly distributed through the left and right sources, COP is in the xy-plane and P is parallel to the x-axis.

An increase of propulsive power through the left sources (s) and/or a decrease of propulsive power through the right source(s) shifts COP, out of the xy-plane, to the left and steers the vehicle, by spinning it about the y-axis, toward the right; an opposite shift of COP to the right steers the vehicle, by spinning it about the y-axis, toward the left.

Steering Controls with Control Surfaces

Being installed bilaterally, the control surfaces of an aquatic vehicle can be operated also for steering controls.

When a right rear or front surface rotates, in either direction from its neutral position, fluid resistance increases on the right side and steers the vehicle to the right.

When a left rear or front surface rotates, in either direction from its neutral position, fluid resistance increases on the left side and steers the vehicle to the left.

Besides steering, operation of the control surfaces also tilts the vehicle into the turn and provides extra support to compensate for the pull of centrifugal force.

Minimizing Surface Roughness

Bumping on surface waves, power boats bounce around and lose control at high speeds. A structural extension, either widthwise or lengthwise, cannot reduce surface roughness and, therefore, is not the solution.

Surface aquatic vehicle 100 maintains control at high speeds by elevating most of its top component above surface waves. An analysis for the elevation is as follows.

Figure 12D:
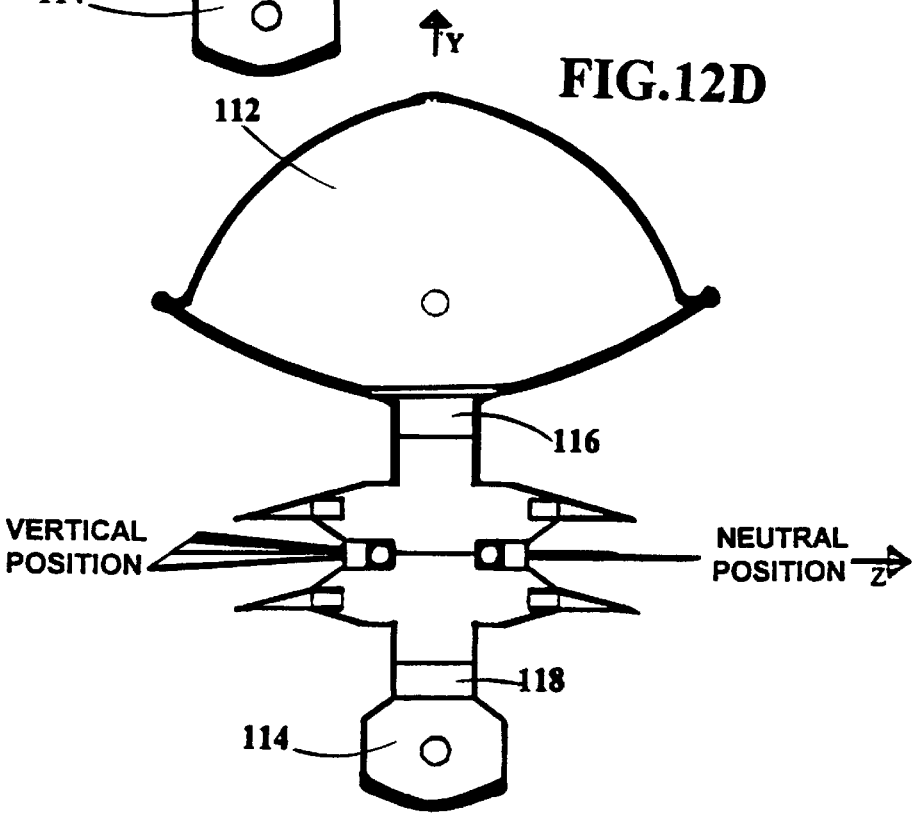

When top extensor 116 is extended, bottom extensor 118 is accordingly extended; the resulting extensions, as shown in FIG. 12B and FIG. 12D, are adjusted to maintain the alignment of P through COR for neutralization QXP+TXR=O in uniform motion. The following is a description of the correspondence between the extensions at the top and at the bottom.

Referring to FIG. 2, D1 and D2 represent the position vectors of, respectively, COR1 and COR2 with reference to COR. Since, as shown also in FIG. 2, D1 and D2 and parallel to the y-axis while R1 and R2 are parallel to the x-axis, D1 is perpendicular to R1 and D2, to R2, and the equation of torques can equivalently be written in terms of the magnitudes, $$d1r1+d2r2=0$$

or as a ratio of the absolute values, $$d1/d2=r2/r1.$$

Let D1' and D2' be the extended D1 and D2, respectively, resulting from the deployment of the top and bottom extensors. To maintain the line of P through COR, D1' and D2' must satisfy the torque equation, $$D140\ XR1+D2'XR2=0.$$

Since the extensions, as shown in FIG. 12B and FIG. 12D, are parallel to the y-axis, D1' is also perpendicular to R1 and D2', to R2, and likewise, the torque equation can equivalently be written in terms of the magnitudes, $$d1'r1+d2'r2=0$$

or as a ratio of the absolute values, $$d1'/d2'=r2/r1.$$

Resulting from the two ratios is $$(d1'-d1)/(d2'-d2)=r2/r1.$$

The results shows the correspondence, in lengths, between the extensions, at the top, from d1 to d1', and at the bottom, from d2 to d2' by the proportionality of r2/r1. Since water is denser than air, in the order of 103, r2 is practically larger than r1, despite the smaller size of the bottom component; the proportionality allows a large extension at the top to raise passengers above surface waves, and a corresponding smaller extension at the bottom to maintain the line of P through COR in uniform motion.

The Comfort for Passengers on Surface Vehicle 100

Passengers' ride is smooth on vehicle 100, because it is above surface waves; with engine noises and vibration remaining underwater, it is also quiet.

The Stability of Surface Vehicle 100 For High Speed Performance

Vehicle 100 obtains its stability for high speed performance not only by avoiding surface waves with most of its top component elevated above the waterline, but also from its double blade control surfaces; operation of the control surfaces provides vehicle 100 the stabilization which conventional vessels, relying on the uncontrolled gravitational torque, cannot attain.

The Efficiency of Surface Vehicle 100 in High Speed Performance

The efficiency of surface vehicle 100 results from two factors, the reduction of water resistance and the proper position of COP.

The Reduction of Water Resistance

Almost half of water resistance on vehicle 100 is reduced with most of its top component (except for part of top extensor 116) moving above the waterline, and water resistance on the lower body is minimized by its small size and large mass. The reduction of fluid resistance allows surface vehicle 100 to move faster with less propulsive power. The lesser power, as needed for high speed propulsion, is a contributing factor to the efficiency of vehicle 100.

The Proper Position of COP

As pointed out, conventional watercraft requires the most power for stability control to neutralize QXP and TXR at high speed in uniform motion, while an aquatic does not have to expend energy for this control power, because QXP and TXR neutralize each other by the alignment of P through COR. Saving the energy for stability control power is another contributing factor to the efficiency of vehicle 100.

The Efficiency of Undersurface Vehicle 10 in High Speed Performance

To move underwater, conventional submarines carry an excess mass of exchanged water in built-in chambers which add extra surface exposure to water resistance.

Riding on lateral boards in water, like an airplane on wings in the air, undersurface vehicle 10 is not burdened with the excess of exchanged water mass and the resistance on extra surface exposure; it is therefore more efficient than a conventional submarine. Furthermore, because of its structural configuration, by which TXR=O and QXP=O, vehicle 10 does not have to expend any energy to control the de-stabilizing effect of QXP and TXR in any stage of motion. Saving of the energy for stability control power is another contributing factor to the efficiency of undersurface aquatic vehicle 10 in high speed performance.

The Exceptional Maneuverability of Undersurface Vehicle 10

A vertical redistribution of mass with the two components, of equal normal cross-sectional areas and similar shapes, maintains TXR=O for motion not only in the x-direction, but in all directions. Undersurface vehicle 10 is therefore capable of the following exceptional maneuverability:

sliding side-to-side without changing its body orientation, ascending/descending without changing its body orientation, reversing its forward/backward motion along the velocity line.

High Speed Power for Undersurface Vehicle 10

With the two components, of equal normal cross-sectional areas and similar shapes, and the alignment of P through COM, the destabilizing effect of QXP is eliminated in all directions and phases of motion. Therefore, propulsion force P, on undersurface vehicle 10, does not have to be restricted in either magnitude or direction. Consequently undersurface vehicle 10 can be powered to move at speeds as high as the engine can offer and the structure can withstand. Note that, being propelled and steered from the rear end and by the lack of structural symmetry, conventional light weigh submarines are limited to low speed operations.

The Conversion of Undersurface Vehicle 10 into an Aero-Space Vehicle

The advantages of undersurface vehicle 10, with components of equal normal cross-sectional areas and similar shapes, are valid not only for motion through water, but also through any medium, such as air and space of no massive resistance. To convert vehicle 10 into an aero-space vehicle, the modification includes:

a change of construction materials into ones of lighter weight and higher heat resistance, a change of engines, from water jet into air jet for maneuvering in the air, and rocket for maneuvering in space, a change of the control surfaces from ones of hydrodynamic form into ones of aerodynamic form, a change of hydrofoils into airfoils, a change of the floatation systems into landing systems.

What is claimed is:

1. An aquatic vehicle comprising:

a top component;

a bottom component positioned below the top component;

at least one propulsion source coupled to the vehicle;

said propulsion source is an outlet of propulsive power; and means for stabilizing the vehicle wherein the stabilizing means comprise at least one vertically retractable extensor connected to the vehicle.

2. The aquatic vehicle of claim 1 wherein the extensor is a hydraulic cylinder which raises and lowers either the top component or the bottom component.

3. The aquatic vehicle of claim 1 wherein the stabilizing means is connected to the bottom component.

4. The aquatic vehicle of claim 1 wherein the stabilizing means is connected to the top component.

5. The aquatic vehicle of claim 4 wherein the stabilizing means is also connected to the bottom component.

6. The vehicle of claim 1 further comprising a control sys em wherein the control system comprises:

a control surface mountable on the vehicle wherein the control surface includes a first blade and a second blade opposite the first blade; and means for rotating the control surface wherein the rotating means comprises a rotational axis being in line with a dividing line between the first and second blades.

7. The vehicle of claim 6 wherein the control surface includes a first set of control surfaces positioned on the vehicle frontward from the propulsion source and a second set of control surfaces positioned on the vehicle rearward from the first set of control surfaces.

8. The vehicle of claim 1 further comprising a lateral board installed on each side of the vehicle to lift the vehicle by reacting to water flow.

9. The vehicle of claim 8 wherein the vehicle includes means for deploying and retrieving the lateral boards.

10. The aquatic vehicle of claim 8 wherein the lateral board includes a first set of lateral boards positioned on the vehicle above the propulsion source and a second set of lateral boards positioned below the first set of lateral boards.

11. An aquatic vehicle comprising:

a top component;

a bottom component positioned below the top component;

at least one propulsion source coupled to the vehicle between a center of mass of the top component and a center of mass of the bottom component; and said propulsion source is outlet of propulsive power.

12. The aquatic vehicle of claim 11 wherein the top and bottom components have a similar shape.

13. The vehicle of claim 11 further comprises a surface support system wherein the surface support system comprises:

a displacement volume structure mountable on the vehicle for increasing the buoyancy of the vehicle; and means for deploying and retrieving of the displacement volume structure.

14. The vehicle of claim 11 further comprising a control system wherein the control system comprises:

a control surface mountable on the vehicle wherein the control surface includes a first blade and a second blade opposite the first blade; and means for rotating the control surface wherein the rotating means comprise a rotational axis being in line with a dividing line between the first and second blades.

15. The vehicle of claim 14 wherein the control surface includes a first set of control surfaces positioned on the vehicle frontward from the propulsion source and a second set of control surfaces positioned on the vehicle rearward from the first set of control surfaces.

16. The aquatic vehicle of claim 11 further comprising a lateral board installed on each side of the vehicle to lift the vehicle by reacting to water flow.

17. The vehicle of claim 16 wherein the vehicle includes means for deploying and retrieving the lateral boards.

18. The aquatic vehicle of claim 16 wherein the lateral board includes a first set of lateral boards positioned on the vehicle above the propulsion source and a second set of lateral boards positioned below the first set of lateral boards.

* * * * *

UNITED STATES PATENT AND TRADEMARK OFFICE

CERTIFICATE OF CORRECTION

PATENT NO. : 6,062,159
DATED : May 16, 2000
INVENTOR(S) : Thanh D. Cao

It is certified that error appears in the above-identified patent and that said Letters Patent is hereby corrected as shown below:

Column 14,
Lines 36-37, replace "control sysem" with -- control system --.

Signed and Sealed this

Fourth Day of December, 2001

*Attest:*

Nicholas P. Godici

NICHOLAS P. GODICI
*Acting Director of the United States Patent and Trademark Office*

*Attesting Officer*